US009249542B2

(12) United States Patent
West

(10) Patent No.: US 9,249,542 B2
(45) Date of Patent: Feb. 2, 2016

(54) ADZER MACHINE HAVING FAILSAFE HEAD ASSEMBLY

(71) Applicant: Progress Rail Services Corporation, Albertville, AL (US)

(72) Inventor: Ronald Gary West, Prattville, AL (US)

(73) Assignee: Progress Rail Services Corporation, Albertville, AL (US)

( * ) Notice: Subject to any disclaimer, the term of this patent is extended or adjusted under 35 U.S.C. 154(b) by 223 days.

(21) Appl. No.: 13/957,153

(22) Filed: Aug. 1, 2013

(65) Prior Publication Data

US 2015/0033975 A1 Feb. 5, 2015

(51) Int. Cl.
*E01B 31/22* (2006.01)

(52) U.S. Cl.
CPC ..... *E01B 31/22* (2013.01)

(58) Field of Classification Search
CPC ..... E01B 31/22; E01B 31/00; E01B 31/20; E01B 29/32; E01B 29/24; E01B 29/16; E01B 29/05
See application file for complete search history.

(56) References Cited

U.S. PATENT DOCUMENTS 2,887,135 A * 5/1959 Fox et al. ..... 144/133.2
4,241,663 A * 12/1980 Lund et al. ..... 104/16
4,274,334 A * 6/1981 Lund ..... 104/2
4,363,274 A * 12/1982 Lund ..... 104/2
4,848,426 A * 7/1989 Whitaker, Jr. ..... 144/133.3
4,890,557 A * 1/1990 Whitaker, Jr. ..... 104/7.3
4,921,732 A * 5/1990 Bounds ..... 427/325
5,337,675 A * 8/1994 Aubermann ..... 104/2
5,435,251 A * 7/1995 Clark et al. ..... 104/16
7,000,659 B1 * 2/2006 McCray et al. ..... 144/133.3
2007/0095242 A1 * 5/2007 Pike ..... 104/7.1
2011/0094624 A1 * 4/2011 Lee et al. ..... 144/133.3
2012/0090498 A1 * 4/2012 Redpath et al. ..... 104/138.2
2015/0033975 A1 * 2/2015 West ..... 104/2

OTHER PUBLICATIONS

Nordco, Figure 6-7. Frame Accessories Tie Guides (Optional), Nov. 2009 (96250240/98250014).

Nordco, Maintenance of Way ~ Work Equipment Bulletin, Product Support Bulletin 2009-17, pp. 1-3.

* cited by examiner

*Primary Examiner* — Jason C Smith

(74) *Attorney, Agent, or Firm* — Finnegan, Henderson, Farabow, Garrett & Dunner, LLP

(57) ABSTRACT

A head assembly is provided for use with adzer machine. The head assembly may have a lift frame, and a cutting head rotationally connected to the lift frame. The head assembly may also have a skid, and a single-acting hydraulic cylinder connecting the skid to the lift frame. The head assembly may further have a spring connecting the skid to the lift frame.

14 Claims, 3 Drawing Sheets

ADZER MACHINE HAVING FAILSAFE HEAD ASSEMBLY

TECHNICAL FIELD

The present disclosure is directed to an adzer machine and, more particularly, to an adzer machine having a failsafe head assembly.

BACKGROUND

An adzer machine is used in the rail industry to resurface worn cross ties, which are the base components of railroad tracks. Over time, support plates that connect rails to the cross ties are forced into the cross ties by the weight of the trains traveling along the tracks. And depending on a differing hardness of individual cross-ties, the support plates are forced deeper into some cross ties than into other cross ties. In order to maintain a straightness of the rails and ensure that the rails are adequately supported along their lengths, the support plates are periodically reset using the adzer machine.

To reset the support plates, one of the rails is separated from the corresponding support plates and the support plates are removed from the cross ties. A head assembly of the adzer machine is then moved along the cross ties at the locations from whence the support plates were removed. The head assembly includes a series of cutters mounted to a rotating hub. As the head assembly is moved along the cross ties, the cutters create a smooth level surface at each cross tie, the smooth level surface of all cross ties being set at a common height. The support plates and rail are then reconnected to the newly resurfaced cross ties.

An exemplary adzer assembly is described in U.S. Patent Application No. 2011/0094624 of Lee, Jr. et al. that published on Apr. 28, 2011 ("the '624 publication"). Specifically, the '624 publication discloses an assembly having a frame, a base plate attached to a center of the frame, an adzer unit rotatably connected to the base plate, and two skids connected fore and aft to the frame via a linkage system. Double-acting hydraulic cylinders are connected between the frame and the linkage system and used to raise and lower the skids relative to the adzer unit as the skids are pushed forward along cross ties of a railroad track.

While the adzer assembly of the '624 publication may perform adequately in some applications, the assembly could be problematic during a hydraulic failure condition. In particular, during a failure condition associated with the double-acting hydraulic cylinders (e.g., when the cylinders suddenly lose pressure), it may be possible for the skids to drop downward into the cross ties or into a space between adjacent cross ties during a transport operation. This uncontrolled movement could result in gashing of the cross ties and/or damage to the skids or adzer unit.

The head assembly of the present disclosure is directed at solving one or more of the problems set forth above and/or other problems in the art.

SUMMARY

In one aspect, the disclosure is related to a head assembly for an adzer machine. The head assembly may include a lift frame, and a cutting head rotationally connected to the lift frame. The head assembly may also include a skid, and a single-acting hydraulic cylinder connecting the skid to the lift frame. The head assembly may include a spring connecting the skid to the lift frame.

In another aspect, the disclosure is related to a method of resurfacing a cross tie of a railroad track. The method may include selectively activating a hydraulic cylinder to extend a skid away from a lift frame and toward the cross tie at a start of a resurfacing operation, and rotating a cutting head connected to the cross tie to remove a portion of the cross tie during the resurfacing operation. The method may also include selectively deactivating the hydraulic cylinder to allow a spring to bias the skid back toward the lift frame at an end of the resurfacing operation.

DETAILED DESCRIPTION

Figure 1:
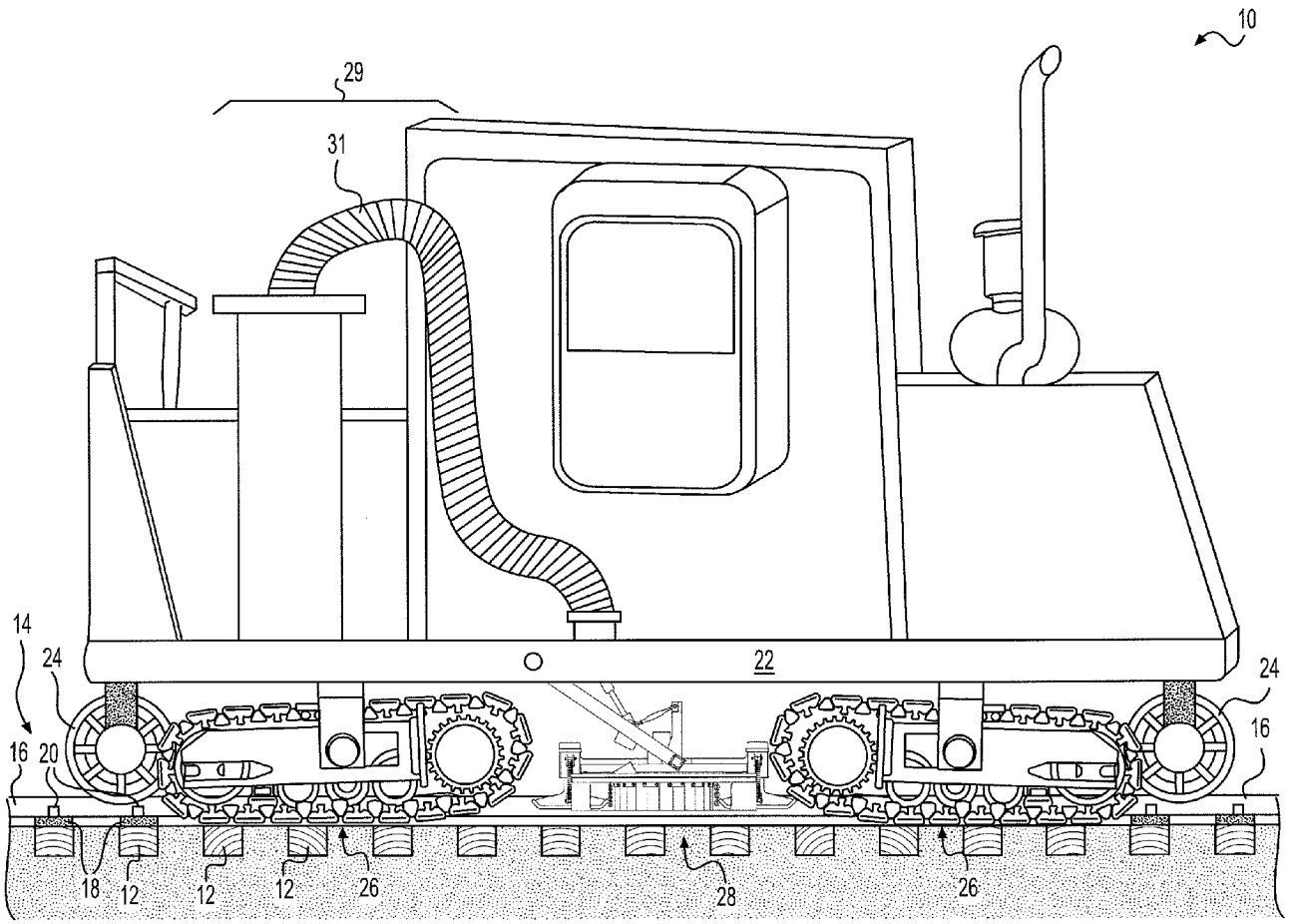
FIG. 1 is a side view illustration of an exemplary disclosed adzer machine.

FIG. 1 illustrates an exemplary adzer machine ("machine") 10 configured to resurface cross ties 12 of a railroad track 14. As is known in the art, cross ties 12 support parallel rails 16 at opposing ends thereof. Rails 16 may be connected to cross ties 12 by way of support plates 18, and fasteners (e.g., spikes) 20 that are driven through plates 18 into cross ties 12. As part of the resurfacing process, one of rails 16, the support plates 18 associated with that rail 16, and the corresponding fasteners 20 may have already been removed at the side of track 14 (i.e., the exposed side shown in FIG. 1) being resurfaced. Only one side of track 14 may be resurfaced at a time, as adzer machine 10 may ride on the remaining rail 16 at the opposing side.

Machine 10 may include, among other things, a machine frame 22, and wheels 24 configured to support frame 22 and ride along the remaining rail 16 located at the end of cross ties 12 not being resurfaced. Machine 10 may also include track-type crawlers ("crawlers") 26 located at the side of track 14 opposite wheels 24. Crawlers 26 may be configured to also support machine frame 22 and ride directly on the ends of cross-ties 12 that are being resurfaced. A forward-located crawler 26 may ride along unfinished surfaces of cross-ties, while an aft-located crawler 26 may ride along newly finished surfaces. Crawlers 26 may have a width about the same as support plates 18 and be aligned to travel along the same locations previously occupied by support plates 18.

Machine 10 may additionally include a head assembly 28 configured to cut into and thereby perform the resurfacing of cross ties 12, and a collection system 29 configured to collect debris generated by the resurfacing process. As shown in FIG. 1, head assembly 28 may be generally located between and longitudinally aligned with crawlers 26. In this embodiment, a shield (e.g., a rubber or canvas drape) 30 may be disposed around head assembly 28 to help contain fragments, dust, and/or debris generated during the resurfacing process, and collection system 29 may include a vacuum hose 31 that terminates within shield 30 and functions to draw the loose debris away from head assembly 28.

Figure 2:
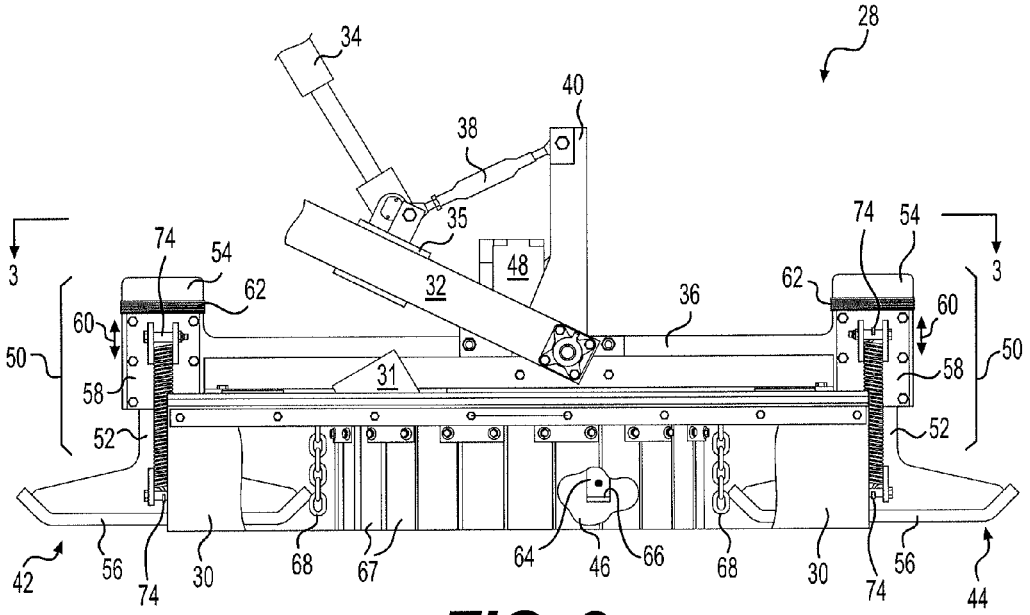
FIG. 2 is a side view illustration of an exemplary disclosed head assembly that may be used in conjunction with the adzer machine of FIG. 1.
Figure 3:
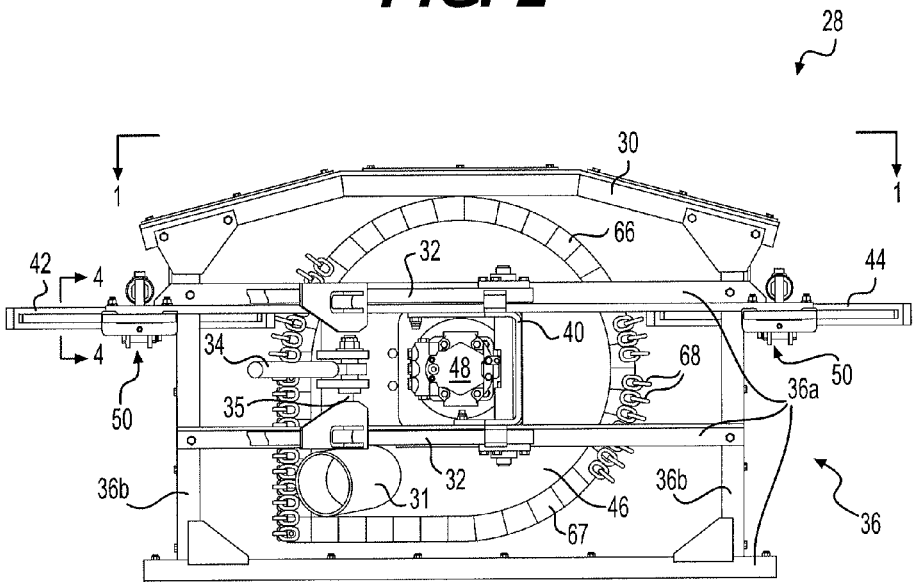
FIG. 3 is a top view illustration of the head assembly of FIG. 2.
Figure 4:
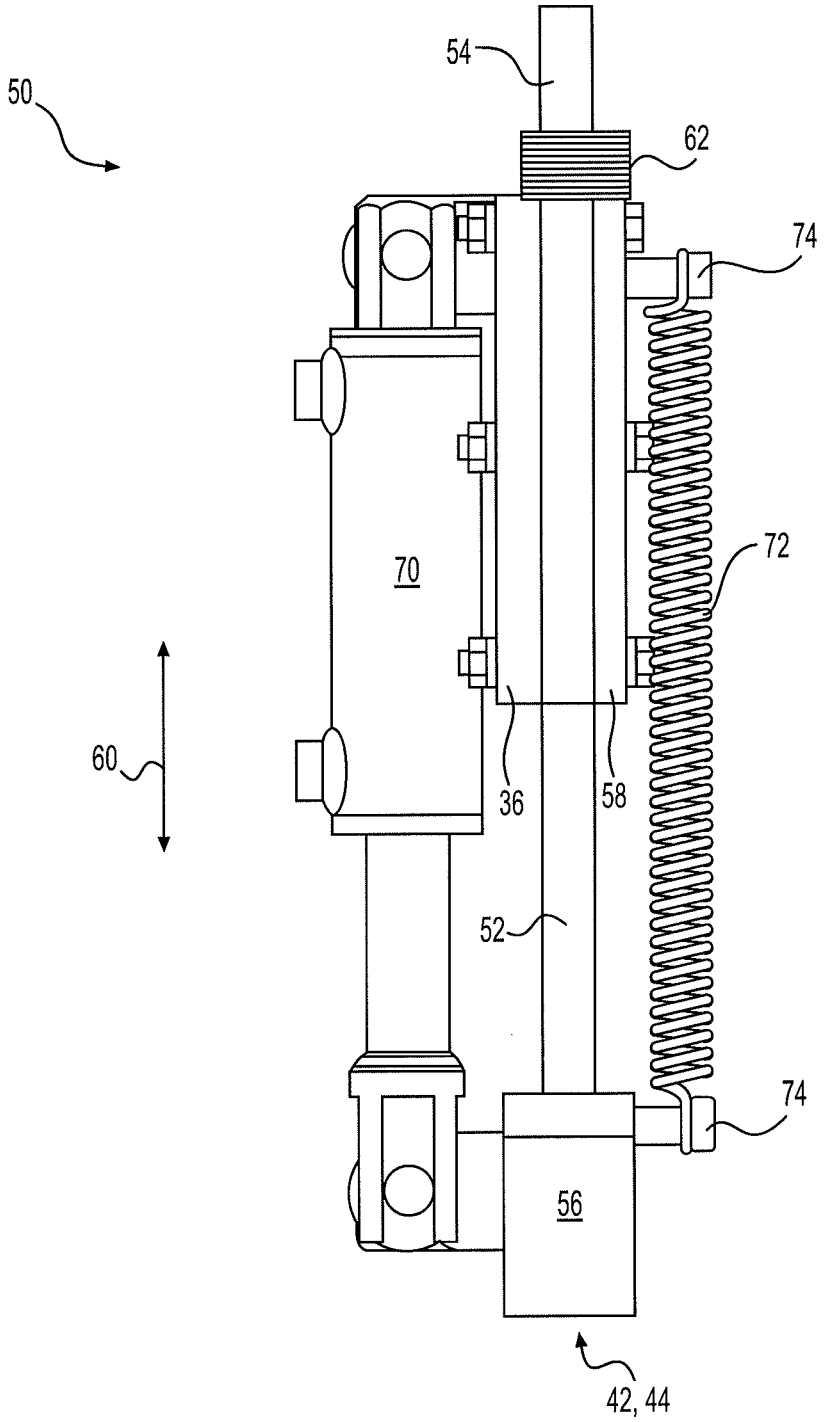
FIG. 4 is a side view illustration of an exemplary disclosed actuator that may be used in conjunction with the head assembly of FIGS. 2 and 3.

As shown in FIGS. 2 and 3, head assembly 28 may be selectively raised and lowered by way of parallel arms 32 and a double-acting lift cylinder 34. Arms 32 may be laterally spaced apart, pivotally connected to machine frame 22 (referring to FIG. 1) at an upper end (i.e., at the end furthest from cross ties 12), and connected to a general center of head assembly 28 (e.g., to adjacent frame members 36*a*) at a lower end. Lift cylinder 34 may be disposed between arms 32, connected directly to machine frame 22 at a head-end, and connected to both of arms 32 at a rod-end by way of a sliding bracket 35. Arms 32 may be used to raise and lower a lift frame 36 of head assembly 28 in coordination with retracting and extending movements of lift cylinder 34, respectively. One or more angle adjustment mechanisms (e.g., a turnbuckle—shown only in FIG. 2 for clarity) 38 may be connected between arms 32 (e.g., between sliding bracket 35) and a tilt link 40 of frame 36, and configured to selectively adjust an angle of head assembly 28 relative to arms 32 and cross ties 12 (referring to FIG. 1). Tilt link 40 may be disposed between and rigidly connected to adjacent frame members 36*a*. In the disclosed embodiment, the height of head assembly 28 above cross ties 12 may be remotely controlled by an operator of machine 10, while the angular orientation of head assembly 28 may be locally controlled. Other ways of raising, lowering, and tilting head assembly 28 may also be possible.

Head assembly 28 may include, among other things, lift frame 36, a front skid 42, a rear skid 44, a cutting head 46, and an actuator 50 associated with each of front and rear skids 42, 44. Lift frame 36 may generally embody a rectangular lattice structure having solid frame members 36*a* that are laterally spaced apart and joined to each at their ends by corresponding cross braces 36*b*. Front and rear skids 42, 44 may be slidingly connected to opposing ends of an outer most frame member 36*a*, at locations between cutting head 46 and fore- and aft-located crawlers 26, respectively. Cutting head 46 may be rotationally connected to the general center of lift frame 36, and powered by a motor 48 (e.g., a hydraulic motor). Actuators 50 may be configured to selectively raise and lower skids 42, 44 relative to lift frame 36, thereby setting a desired height of cutting head 46.

Front and rear skids 42, 44 may each include a stem portion 52 having a generally T-shaped end 54, and a base plate 56 connected to stem portion 52 opposite end 54. Stem portion 52 may have a generally rectangular cross-section, and be configured to slide within a bracket 58 (e.g., in a vertical direction indicated by an arrow 60) at distal ends of lift frame 36. During the sliding movement of stem portion 52, end 54 may function as a stop that engages bracket 58 to inhibit the associated skid 42, 44 from sliding completely out of bracket 58. One or more shims 62 (e.g., a shim pack) may be selectively placed around stem portion 52 at a location between end 54 and bracket 58, to thereby adjust an allowable extension distance of skids 42, 44 relative to lift frame 36. Base plate 56 may be configured to slide along exposed upper surfaces of cross ties 12 (referring to FIG. 1) as machine 10 is propelled forward by crawlers 26. Because base plate 56 of front skid 42 may ride along unfinished surfaces and base plate 56 of rear skid 44 may ride along finished surfaces (i.e., surfaces that have been machined to a lower elevation), a different number of shims 62 may be used in associated with front and rear skids 42, 44.

Cutting head 46 may include a hub 64 rotated by motor 48, and a plurality of cutting teeth or blades 66 mounted around a periphery of hub 64 at a lower side thereof. As hub 64 is driven by motor 48 and head assembly 28 is lowered into cross ties 12, blades 66 may engage the worn surface of cross ties 12 and remove a layer of material having a desired thickness. The material may be thrown radially outward by the rotating blades 66 and against shield 30 during operation. In some embodiments, additional layers of shielding may be provided to help ensure that the removed material does not leave the confines of machine 10. For example, an inner layer of rubber flaps 67 may be located around blades 66, and a plurality of chain segments 68 (some segments 68 removed from FIGS. 2 and 3 for clarity) may be disposed around flaps 67 to limit a deflection thereof. In the disclosed embodiment, the terminal end of vacuum hose 31 is located radially inward of flaps 67, although other arrangements may also be possible.

Each actuator 50 may include components remotely controlled by the operator of machine 10 to selectively raise skids 42, 44 at the start and finish of the resurfacing operation. These components may include, among other things, a hydraulic cylinder 70, and a spring 72 paired together with hydraulic cylinder 70. Hydraulic cylinder 70 may be connected at a first end (e.g., at a head-end by way of a rigid tube connection) to lift frame 36 and at a second end (e.g., at a rod-end by way of a pivot connection) to the corresponding skid 42, 44. Spring 72 may extend between these same general locations at a side of lift frame 36 opposite hydraulic cylinder 70, for example between parallel pins 74 protruding outward from bracket 58 and stem portion 52 at base plate 56.

Hydraulic cylinder 70 may be selectively activated (i.e., filled with pressurized fluid) to move in a single direction. That is hydraulic cylinder 70 be a single-acting cylinder and powered to only extend at the start of the resurfacing operation. Hydraulic cylinder 70 may remain filled with pressurized fluid throughout normal operation, such that skids 42, 44 remain in desired extended positions. Spring 72 may be a tensile spring and used to cause retraction of hydraulic cylinder 70 (i.e., to bias skids 42, 44 back toward lift frame 36) at the end of the resurfacing operation when the pressurized fluid is intentionally drained from hydraulic cylinder 70. However, spring 72 may also be used to cause retraction of hydraulic cylinder 70 at any time that hydraulic cylinder 70 unintentionally loses pressure (e.g., during a failure condition). In the disclosed embodiment, hydraulic cylinder 70 may be located outside of lift frame 36; and spring 72 may be located inside of lift frame 36. In this configuration, hydraulic cylinder 70 may be protected somewhat from the material removal process occurring within lift frame 36. It is contemplated, however, that other configurations may also be possible.

INDUSTRIAL APPLICABILITY

The disclosed head assembly may be used in conjunction with any conventional adzer machine to perform a cross tie resurfacing operation. At the start of the operation, hydraulic cylinders 70 may be activated (i.e., filled with pressurized fluid) to extend skids 42, 44 to desired positions, thereby setting a height of cutting head 46. This height and/or the angle of cutting head 46 may be adjusted through the use of shims 62 and angle adjusting mechanism 38, respectively. Motor 48 may then be used to drive the rotation of cutting head 46, and crawlers 26 may be used to propel adzer machine 10. As cutting head 46 removes material from the exposed upper surfaces of cross ties 12, the material may be swept away from cutting head 46 by collection system 29.

At the end of the resurfacing operation, motor 48 may be stopped and skids 42, 44 raised for transport. To raise skids 42, 44, hydraulic cylinders 70 may be deactivated (i.e., the pressurized fluid may be intentionally drained from hydraulic cylinder 70). When this occurs, springs 72 may bias skids 42, 44 back toward lift frame 36, where skids 42, 44 may be held by springs 72 away from cross ties 12. In similar fashion, anytime hydraulic cylinders 70 unintentionally lose pressure, springs 72 may likewise return skids 42, 44 to their transport positions. In this way, skids 42, 44 may be kept from falling into engagement with cross ties 12 and/or into the area between cross ties 12, and be kept from causing damage to machine 10 and/or tracks 14.

It will be apparent to those skilled in the art that various modifications and variations can be made to the disclosed head assembly and adzer machine without departing from the scope of the disclosure. Other embodiments of the seal will be apparent to those skilled in the art from consideration of the specification and practice of the head assembly and adzer machine disclosed herein. It is intended that the specification and examples be considered as exemplary only, with a true scope of the disclosure being indicated by the following claims and their equivalents.

What is claimed is:

1. A head assembly for an adzer machine, comprising:
a lift frame;
a cutting head rotationally connected to the lift frame;
a skid;
a single-acting hydraulic cylinder connecting the skid to the lift frame;
a spring connecting the skid to the lift frame; and
a shim pack located between the skid and the lift frame;
wherein:
the skid includes a stem portion, a generally T-shaped end connected to the stem portion, and a base plate connected to the stem portion opposite the generally T-shaped end;
the lift frame includes a bracket that encircles a portion of the stem portion; and
the shim pack is located around the stem portion, between the bracket and the generally T-shaped end.

2. The head assembly of claim 1, wherein the single-acting hydraulic cylinder is connected at a head-end to the lift frame and at a rod-end to the skid.

3. The head assembly of claim 2, wherein the single-acting hydraulic cylinder is configured to extend and push the skid away from the lift frame when selectively activated.

4. The head assembly of claim 3, wherein the spring is configured to bias the skid back toward the lift frame.

5. The head assembly of claim 4, wherein the spring is configured to cause retraction of the single-acting hydraulic cylinder when the single-acting hydraulic cylinder is deactivated.

6. The head assembly of claim 1, wherein the spring extends between the bracket and the base plate.

7. The head assembly of claim 1, wherein the spring is a tensile spring.

8. The head assembly of claim 1, further including a pair of lift arms pivotally connected at one end to a general center of the lift frame and pivotally connected at an opposing end to a machine frame of the adzer machine.

9. The head assembly of claim 8, further including a double-acting lift cylinder disposed between the machine frame of the adzer machine and the lift arms, the double-acting lift cylinder being configured to selectively raise and lower the cutting head, the lift frame, and the skid.

10. The head assembly of claim 8, further including a turnbuckle disposed between the lift arms and the lift frame, the turnbuckle configured to selectively affect an angle of the cutting head.

11. The head assembly of claim 1, wherein:
the skid is a first skid;
the single-acting hydraulic cylinder is a first single-acting hydraulic cylinder;
the spring is a first spring; and
the head assembly further includes:
a second skid;
a second single-acting hydraulic cylinder connecting the second skid to the lift frame; and
a second spring connecting the second skid to the lift frame.

12. The head assembly of claim 11, wherein the first skid, cutting head, and second skid are in fore/aft alignment with each other.

13. The head assembly of claim 1, wherein:
the single-acting hydraulic cylinder is located outside of the lift frame; and
the spring is located inside the lift frame at a side of the skid opposite the single-acting hydraulic cylinder.

14. An adzer machine, comprising:
a machine frame;
wheels configured to support the machine frame and ride along a rail located at first ends of a plurality of cross ties;
track-type crawlers located opposite the wheels, configured to support the machine frame, and ride along second ends of the plurality of cross ties;
a rotatable cutting head configured to resurface the second ends of the plurality of cross ties and being located between the track-type crawlers;
skids configured to slide along the second ends of the plurality of cross ties and being located between the rotatable cutting head and the track-type crawlers;
a lift frame configured to mount the rotatable cutting head;
parallel lift arms pivotally connecting the lift frame to the machine frame;
a double-acting lift cylinder disposed between the parallel lift arms and configured to raise and lower the parallel lift arms;
a plurality of single-acting hydraulic cylinders, each connecting the lift frame to a corresponding one of the skids and to the lift frame, the plurality of single-acting hydraulic cylinders being configured to only extend the skids relative to the lift frame;
a plurality of springs each connecting a corresponding one of the skids to the lift frame and configured to bias each of the skids back toward the lift frame; and
a shim pack located between the skid and the lift frame;
wherein:
the skid includes a stem portion, a generally T-shaped end connected to the stem portion, and a base plate connected to the stem portion opposite the generally T-shaped end;
the lift frame includes a bracket that encircles a portion of the stem portion; and
the shim pack is located around the stem portion, between the bracket and the generally T-shaped end.

* * * * *